United States Patent [19]

Peham

[11] Patent Number: 4,532,850

[45] Date of Patent: Aug. 6, 1985

[54] MUSICAL RESILIENT BAND NOVELTY DEVICE

[75] Inventor: Engelbert J. Peham, St. Paul, Minn.

[73] Assignee: Peham Plastics, Inc., St. Paul, Minn.

[21] Appl. No.: 515,651

[22] Filed: Jul. 21, 1983

[51] Int. Cl.[3] ..... G10D 1/00
[52] U.S. Cl. ..... 84/173
[58] Field of Search ..... 84/173, 297 R, 297 S, 84/455

[56] References Cited

U.S. PATENT DOCUMENTS 1,636,133 7/1927 Horton ..... 84/173 X
2,529,584 11/1950 Alexander ..... 84/173

*Primary Examiner*—Benjamin R. Fuller
*Attorney, Agent, or Firm*—Jacobson and Johnson

[57] ABSTRACT

A band of rubber or resilient material which produces musical tones when plucked while in a stretched or taut condition has visible markings designating where the band can be pinched to produce various musical tones when plucked. The band may be mounted in the crown of an imitation straw hat or in other bowl shaped novelty devices.

11 Claims, 5 Drawing Figures

MUSICAL RESILIENT BAND NOVELTY DEVICE

BACKGROUND OF THE INVENTION

This invention is directed toward use as or with inexpensive novelty devices or articles and particularly those which might be associated with the plucking or strumming of a stringed instrument such as a guitar or banjo. Typical of this might be the placement of a rubber band of this nature within the crown of an imitation straw hat or within the bowl-like area of an inexpensive container for candy or the like which might be outwardly shaped like a guitar or banjo. In U.S. Pat. No. 3,765,030 there is disclosed a rubber band located within the crown area of an imitation straw hat. There the band is used solely for the purpose of sizing the hat to the wearer's head. The instant invention might additionally be used for sizing purposes but that is not its primary function and it has uses other than in a hat.

SUMMARY OF THE INVENTION

A rubber or resilient band having the characteristic of producing a melodic tone when plucked while held in a stretched condition contains indicia such as number markings or the like designating locations on the band where it can be pinched to produce certain various melodic tones when plucked while held in the stretched condition. As an added feature, the band has attaching studs at its ends to hold it anchored in place while being plucked or strummed in the stretched condition.

DESCRIPTION OF THE PREFERRED EMBODIMENTS

Figure 1:
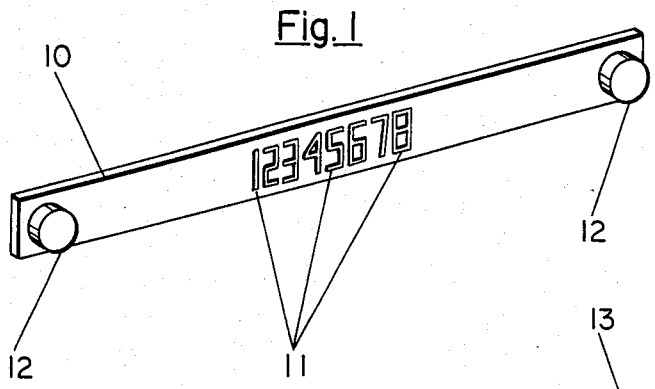
FIG. 1 is an illustration of a preferred embodiment of the invention.
Figure 2:
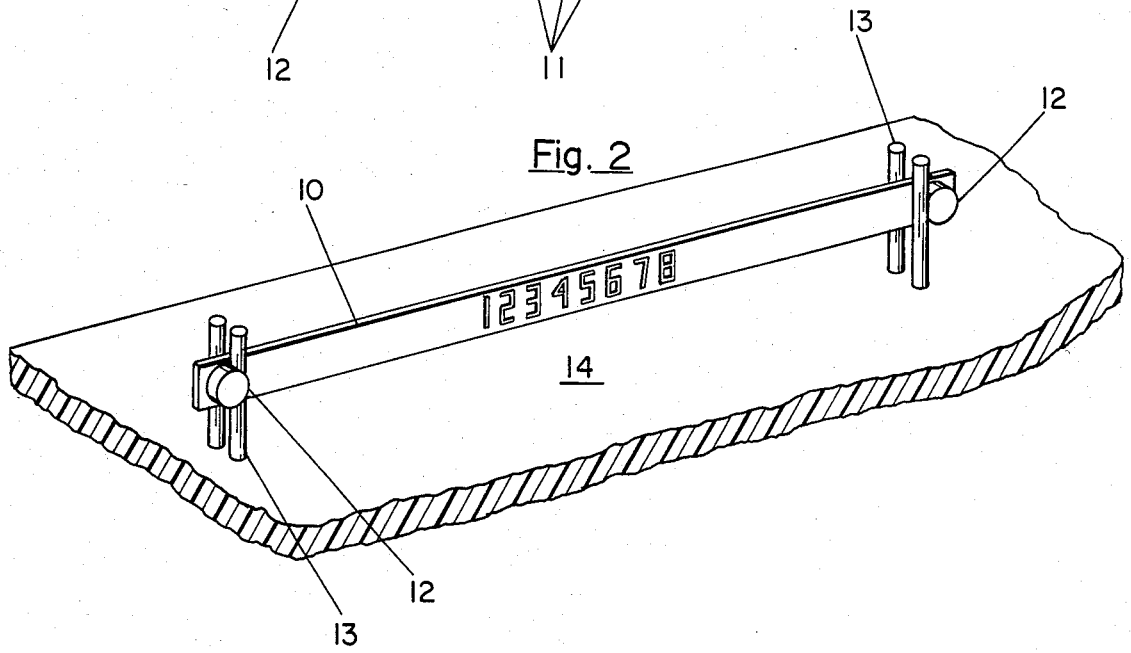
FIG. 2 illustrates a manner of holding the resilient band in a stretched condition.

FIG. 1 illustrates a strip of resilient material 10 containing a set of indicia 11 consisting of a series of digits 1–8 on its face. A pair of studs 12 are formed at opposite ends on the face of the band 10. The band 10 can be held in some convenient fashion in a stretched condition and pinched with two fingers of one hand at one of the markings 11 and then plucked with another finger near one end of the band and it will produce a melodic tone. The pinching fingers can be moved selectively to others of the markings and plucked to produce a series of melodic tones and with the proper arrangement of these melodic tones a melodic tune will result. The studs 12 provide convenient attaching means for anchoring the band 10 in its stretched condition. Typically, for example, two sets of spaced apart pins 13 can provide a temporary anchoring means with one end of the band 10 slipped between the pins of one set with stud 12 outside the pins and the band stretched to the other set of pins and the other end of the band slipped between the two pins of the other set with stud 12 on the outside. The band 10 will then be held in this stretched condition. When no longer in use the band 10 can be released by slipping it out from between the pins 13. It has been found that this is a convenient way for attaching bands to a molded article. For example, when attaching the band to a molded imitation straw hat, the band is stretched between two sets of pins in the mold and after the ends of the bands are securely molded in place in the hat the band slips out from between the pins when the hat is removed from the mold. This is not considered to be a novel aspect of the instant invention. It is merely described here to show one way in which the band can be releasably secured in its stretched condition with the markings or indicia located between the anchoring points.

Figure 3:
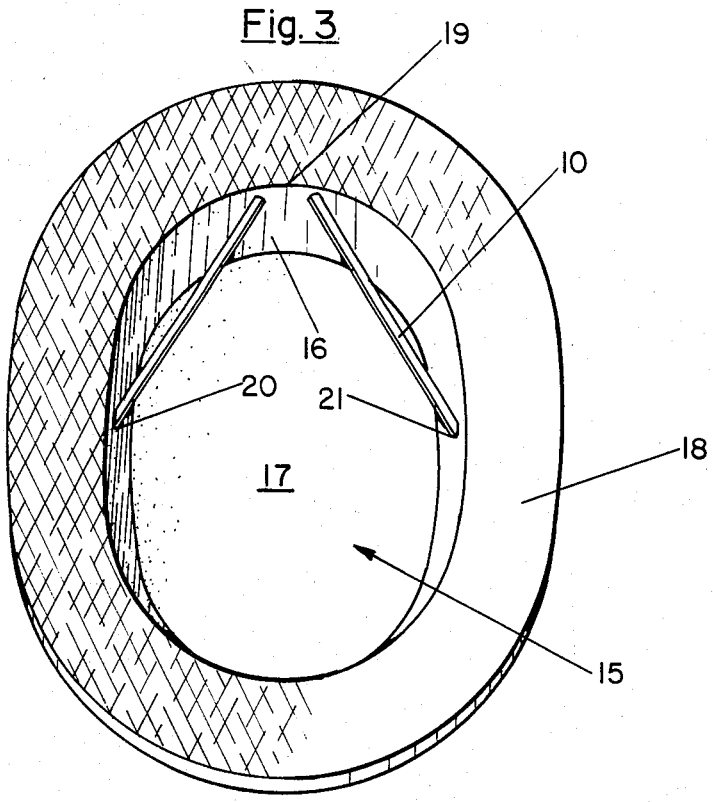
FIG. 3 is an illustration showing an embodiment of the invention as incorporated into an imitation straw hat.
Figure 4:
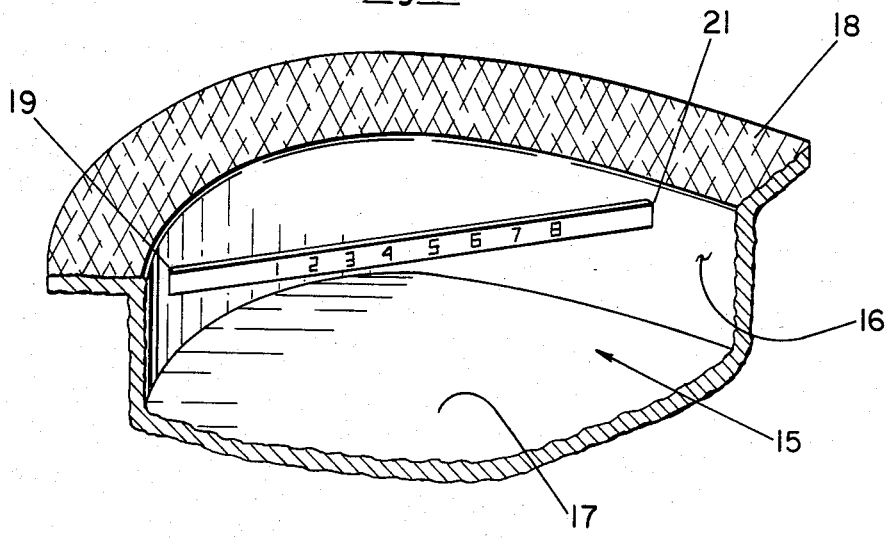
FIG. 4 is a more detailed view of FIG. 3.

In a typical application the band 10 might be attached within the crown area 15 of an imitation straw hat which is defined by the riser portion 16 of the hat and the top or hat cover 17. Typically, the imitation straw hat also has a flat brim 18. In the embodiment illustrated in FIGS. 3 and 4 the band is anchored at its two ends 20 and 21 and also at a midpoint generally designated by reference number 19. In this instance it is preferred that the markings 11 appear on both sections of the band between the three anchoring points, i.e., in the section of the band between anchoring points 19 and 20 and between anchoring points 19 and 21. Studs 12 at the ends of band 10 serve to hold the ends of the band more securely attached to the riser of the hat when the band is molded to the hat. As an added feature directions for use of the band to produce the melodic tones or tunes can be printed on the inner surface of the top of the hat 17. These instructions describe at which of the respective markings the band should be pinched in a certain sequence in order to produce a certain tune when plucked. For example, the band was installed in a molded plastic hat, as described above, and at the existing tautness the printed instructions inside the hat cover describe that the well-known melody for "Shave and a Haircut, Six Bits" can be played by plucking the band while pinching numbers 4, 2, 2, 3, 2, 4, 5 in succession.

Figure 5:
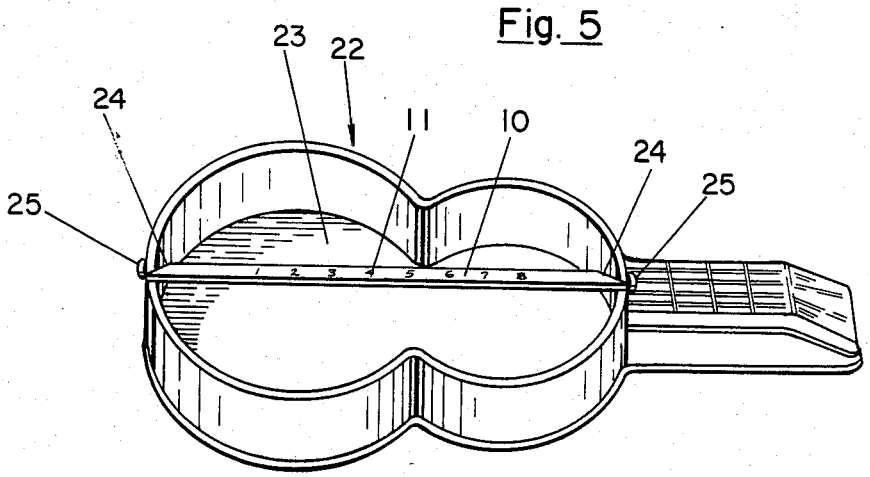
FIG. 5 is an illustration of an embodiment of the invention as attached to a banjo shaped container.

FIG. 5 illustrates another typical manner of use of the instant invention. A molded plastic container designated generally by reference numeral 22 is preferably in the shape of a guitar or banjo with the string holding portion being bowled or hollow in the area generally designated 23. This area 23 would normally serve as a holder for candy or the like. At opposite ends in the wall of the bowled area are slots 24. The band 10 is slipped into the slots and is held in this stretched or taut condition by studs 25 formed at the outer ends of the band 10. The markings 11 located between the two attachment points designate the location at which the band should be pinched when in this stretched condition and plucked to produce the melodic tones. Similarly, as with the straw hat embodiment illustrated in FIG. 3, instructions for the playing of the band can be printed on the inner surface of the bowled area 23. When not in use for this purpose the band 10 can be slipped out of the slots 24 and the container used for its normal purpose or discarded.

I claim:

1. As a novelty device:

a resilient band characterized by producing a melodic tone when plucked while in a stretched condition;

means for anchoring said band;

spaced-apart means on said band for attaching said band to said anchoring means in a stretched condition; and visible markings on said band located between said attaching means for designating locations on the band for pinching the band to produce melodic tones when plucked while anchored in a stretched condition.

2. The device as in claim 1 wherein said markings comprise raised indicia on the band.

3. The device as in claim 1 wherein said markings comprise printed indicia on said band.

4. The invention as in claim 1 wherein said band has two ends and said attaching means are located at its ends.

5. The invention as in claim 1 wherein said attaching means comprises raised studs on said band.

6. A novelty device comprising:

a molded semi-rigid bowl-shaped article;

a resilient band characterized by producing a musical tone when plucked while in a stretched condition, said band being anchored at spaced-apart points on said bowl-shaped article and extending between said anchoring points substantially completely within the bowl area of the molded article in a stretched condition; and visible markings on said band between said anchoring points for designating locations on the band for pinching the band to produce various melodic tones when plucked while attached to said anchoring points.

7. The novelty device as described in claim 6 wherein:

said bowl-shaped article comprises an imitation straw hat having a riser portion and a top forming a crown area, said band being anchored at spaced points on said riser and extending between said anchoring points inside the crown area.

8. The novelty device as in claim 6 wherein said markings comprise raised indicia on the band.

9. The novelty device as in claim 6 wherein said markings comprise printed indicia on the band.

10. The novelty device as in claim 6 wherein said band contains spaced-apart means for attaching the band to the anchoring points on said bowl-shaped article.

11. The novelty device as in claim 10 wherein said attaching means comprises raised studs on said band.

* * * * *